US009245674B2

(12) United States Patent
Li et al.

(10) Patent No.: US 9,245,674 B2
(45) Date of Patent: Jan. 26, 2016

(54) RARE-EARTH PERMANENT MAGNETIC POWDER, BONDED MAGNET, AND DEVICE COMPRISING THE SAME

(75) Inventors: Hongwei Li, Beijing (CN); Dunbo Yu, Beijing (CN); Yang Luo, Beijing (CN); Kuoshe Li, Beijing (CN); Shipeng Li, Beijing (CN); Min Wang, Beijing (CN); Yongqiang Yuan, Beijing (CN)

(73) Assignee: Grirem Advanced Materials Co., Ltd., Beijing (CN)

( * ) Notice: Subject to any disclaimer, the term of this patent is extended or adjusted under 35 U.S.C. 154(b) by 0 days.

(21) Appl. No.: 13/637,859

(22) PCT Filed: Mar. 28, 2011

(86) PCT No.: PCT/CN2011/072228

§ 371 (c)(1),
(2), (4) Date: Sep. 27, 2012

(87) PCT Pub. No.: WO2011/120416

PCT Pub. Date: Oct. 6, 2011

(65) Prior Publication Data

US 2013/0020527 A1 Jan. 24, 2013

(30) Foreign Application Priority Data

Mar. 29, 2010 (CN) ..... 2010 1 0134351

(51) Int. Cl.

| | |
|---|---|
| ***C22C 38/12*** | (2006.01) |
| ***H01F 1/059*** | (2006.01) |
| ***C22C 33/02*** | (2006.01) |
| ***C22C 38/00*** | (2006.01) |
| ***C22C 38/02*** | (2006.01) |
| ***C22C 38/10*** | (2006.01) |
| ***C22C 45/02*** | (2006.01) |

(52) U.S. Cl.

CPC ..... *H01F 1/0596* (2013.01); *C22C 33/0278* (2013.01); *C22C 38/001* (2013.01); *C22C 38/002* (2013.01); *C22C 38/005* (2013.01); *C22C 38/02* (2013.01); *C22C 38/10* (2013.01); *C22C 38/12* (2013.01); *C22C 45/02* (2013.01); *Y10T 428/2982* (2015.01)

(58) Field of Classification Search

CPC C22C 33/0278; C22C 38/001; C22C 38/002; C22C 38/005; C22C 38/02

USPC ..... 148/101, 302–303

See application file for complete search history.

(56) References Cited

U.S. PATENT DOCUMENTS

| | | | | |
|---|---|---|---|---|
| 5,968,290 | A * | 10/1999 | Sakurada et al. | 148/302 |
| 6,406,559 | B2 * | 6/2002 | Sakurada et al. | 148/122 |
| 7,481,895 | B2 * | 1/2009 | Iriyama et al. | 148/301 |
| 2003/0145910 | A1 * | 8/2003 | Mochizuki et al. | 148/302 |

FOREIGN PATENT DOCUMENTS

| | | |
|---|---|---|
| CN | 1059230 | 3/1992 |
| CN | 1072796 | 6/1993 |
| CN | 1139279 | 1/1997 |
| CN | 1295714 A | 5/2001 |
| CN | 1326200 A | 12/2001 |
| CN | 101599329 | 4/2011 |
| JP | 2004-193207 | 7/2004 |
| JP | 2006-183151 A | 7/2006 |

OTHER PUBLICATIONS

SIPO Examination Report issued Jun. 19, 2014.

* cited by examiner

*Primary Examiner* — Jie Yang
(74) *Attorney, Agent, or Firm* — Fay Sharpe LLP

(57) ABSTRACT

A rare-earth permanent magnetic powder, a bonded magnet, and a device comprising the bonded magnet are provided. The rare-earth permanent magnetic powder is mainly composed of 7-12 at % of Sm, 0.1-1.5 at % of M, 10-15 at % of N, 0.1-1.5 at % of Si, and Fe as the balance, wherein M is at least one element selected from the group of Be, Cr, Al, Ti, Ga, Nb, Zr, Ta, Mo, and V, and the main phase of the rare-earth permanent magnetic powder is of $TbCu_7$ structure. Element Si is added into the rare-earth permanent magnetic powder for increasing the ability of SmFe alloy to from amorphous structure, and for increasing the wettability of the alloy liquid together with the addition of element M in a certain content, which enables the alloy liquid prone to be injected out of a melting device. The average diameter of the rare-earth permanent magnetic powder is in the range of 10-100 μm, and the rare-earth permanent magnetic powder is composed of nanometer crystals with average grain size of 10-120 nm or amorphous structure.

10 Claims, No Drawings

RARE-EARTH PERMANENT MAGNETIC POWDER, BONDED MAGNET, AND DEVICE COMPRISING THE SAME

TECHNICAL FIELD

This application, which belongs to the field of rare-earth permanent magnetic material, relates to a rare-earth permanent magnetic powder, a bonded magnet and a device using the bonded magnet.

BACKGROUND

The bonded rare-earth permanent magnet has been widely used in electronic equipment, office automation, automobile and so on, especially micro and special electric machines due to its advantages of well formability, high dimensional precision, high magnetic properties or the like. In order to meet the requirements for equipment miniaturization, it is necessary to further optimize the performance of bonded magnetic powder which used in the material.

Currently, the widely used magnetic powder is NdFeB magnetic powder prepared by rapid quenching method. It is not suitable for requiring the performance of the material under harsh environment due to its poor corrosion resistance and temperature resistance. The samarium-iron-nitrogen permanent magnetic powder effectively overcomes the above problems. The magnetic energy product of the prepared magnetic powder is above 17MGOe, higher than the rapidly quenched NdFeB magnetic powder. Meanwhile, the corrosion resistance and temperature resistance of the prepared magnetic powder is better than the NdFeB, it is a relatively promising rear-earth permanent magnetic material which has attracted extensive attention.

U.S. Pat. No. 5,482,573 discloses a rare-earth permanent magnetic material with a component of $R1_xR2_yA_zM_{100-x-y-z}$, which occupies the position of rare-earth element by addition of R2, i.e., Zr, Hf, and Sc, reduces the average atomic radius of rare-earth atomic site, thus increasing the concentration of M in the main phase, while accelerating the formation of $TbCu_7$ main phase.

U.S. Pat. No. 5,716,462 discloses a rare-earth permanent magnetic material with a component of $R1_xR2_yB_zA_uM_{100-x-y-z-u}$, which improves the residual magnetism by addition of element B, while, accelerating the formation of $TbCu_7$ main phase by addition of elements Zr, Hf and Sc. M is only Fe or FeCo.

U.S. Pat. No. 6,758,918 discloses a samarium-iron-nitrogen permanent magnetic material with a component of $Sm_xFe_{100-x-y-v}M1_yN_v$, which improves the square degree and coercivity by addition of M1 which is Zr and Hf, while reducing rapid quenching wheel speed by changing preparation process and rapid quenching copper wheel material.

However, the experimenter finds in the research that when the samarium-iron alloy is prepared by the rapid quenching method, the viscosity of samarium-iron alloy is a principal problem. Since the viscosity of the samarium-iron alloy is too large, the samarium-iron alloy can not be spouted out stably and continuously during the preparation process, which affects the formation of amorphous $TbCu_7$ during rapid quenching, and the samarium-iron-nitrogen permanent magnetic material with excellent performance cannot be prepared stably.

SUMMARY OF THE INVENTION

The inventor of this application finds that, the problem of too large viscosity and weak glass-forming ability during the preparation process may be improved by optimizing the component of the material and reducing the viscosity of the alloy liquid.

The rare-earth permanent magnetic powder of this application was mainly formed by nitriding the flaky samarium-iron alloy which prepared by rapid quenching method. The main preparation process is as follows:

(1) firstly proportioning certain samarium-iron alloy, smelting the samarium-iron alloys by Medium-Frequency processing, arc melting to obtain alloy ingots, initially crushing the ingots to obtain the alloy block of several millimeters;

(2) passing alloy liquid obtained by induction melting of the alloy block through a nozzle onto a rotary water-cooled copper wheel, obtaining the flaky samarium-iron alloy powder after emergency cooling the liquid;

(3) crushing the prepared flaky samarium-iron alloy powder and screening to remove ultrafine powder, obtaining powder with particle size of 10~100 μm;

(4) annealing the obtained samarium-iron alloy powder at 750° C. for 5~30 min, homogenizing grain structure, then nitriding at about 450° C. for 30 min under industrial pure nitrogen, gas mixture of hydrogen and ammonia or the like as the nitrogen source;

(5) obtaining samarium-iron-nitrogen rare-earth permanent magnetic powder with excellent performance after nitriding.

In these preparation processes, the key step is Step (2) the formation of flaky samarium-iron alloy powder. Since the speed of orientation movement of each liquid layer in flowing liquid is different, and relative movement occurs between adjacent liquid layers, an internal friction is generated between the adjacent two liquid layers to prevent the continuation of the movement, and to make the liquid flow slowly. This is so-called sticking phenomenon. However, due to its own properties, namely, its large viscosity of the samarium-iron alloy liquid, there is a situation of discontinuous or discontinued spraying, which affects uniformity of the formed flake and production efficiency of the process.

The inventor finds that, under experimental conditions, the addition of element Si can effectively improve the glass-forming ability of the material, advantaging the formation of $TbCu_7$ phase, while the addition of element M reduce the viscosity of the material, advantaging the preparation by rapid quenching method. The specific contents of the invention are as follows:

The rare-earth permanent magnetic powder provided by this application is composed of Sm, Fe, M, Si and N, wherein M is at least one of Be, Cr, Al, Ti, Ga, Nb, Zr, Ta, Mo, and V, and at least 80 vol % of the rare-earth permanent magnetic powder is $TbCu_7$ phase.

Preferably, in the rare-earth permanent magnetic powder, M is at least one of Cr, Zr, Mo and V.

The content of element samarium in the rare-earth permanent magnetic powder is in the range of 7~12 at %, the content of M is in the range of 0.1~1.5 at %, the content of N is in the range of 10~15 at %, the content of Si is in the range of 0.1~1.0 at %, and Fe as the balance.

Preferably, the content of element samariumin the rare-earth permanent magnetic powder is in the range of 7~10 at %, the content of Si is in the range of 0.2~0.8 at %, the content of M is in the range of 0.5~1.5 at %, the content of N is in the range of 10~15 at %, and Fe as the balance.

Preferably, the M in the rare-earth permanent magnetic powder is composed of Zr and R, wherein R is at least one of Be, Cr, Al, Ti, Ga, Nb, Ta, Mo, and V.

Preferably, the content of Sm in the rare-earth permanent magnetic powder is in the range of 7~12 at %, the content of Si is in the range of 0.1~1.5 at %, the content of Zr is in the range of 0.1~3 at %, the content of N is in the range of 5~20 at %, the content of R is in the range of 0.1~1.5 at %, and Fe as the balance.

Preferably, in the rare-earth permanent magnetic powder, the atomic ratio of R to Zr is in the range of 0.05~0.5.

Preferably, in the rare-earth permanent magnetic powder, the atomic ratio of R to Zr is in the range of 0.05~0.2.

Preferably, part of element Fe in the rare-earth permanent magnetic powder is replaced by element Co, and the element Co accounts for 0~30 at % of the rare-earth permanent magnetic powder.

Preferably, part of element Sm in the rare-earth permanent magnetic powder is replaced by other rare-earth elements, and the other rare-earth elements account for 0~10 at % of the rare-earth permanent magnetic powder.

Preferably, the content of $TbCu_7$ phase in the rare-earth permanent magnetic powder is above 90 vol %.

Preferably, the content of $TbCu_7$ phase in the rare-earth permanent magnetic powder is above 95 vol %.

Preferably, the content of α-Fe phase in the rare-earth permanent magnetic powder is below 1 vol %.

Preferably, the average thickness of the rare-earth permanent magnetic powder is 10~100 μm, and the rare-earth permanent magnetic powder is composed of nanometer crystals with an average size of 10~120 nm and amorphous structure.

Preferably, the average thickness of the rare-earth permanent magnetic powder is 20~60 μm, and the rare-earth permanent magnetic powder is composed of nanometer crystals with an average size of 20~80 nm and amorphous structure.

According to another aspect of the application, there is provided an isotropic bonded magnet, wherein the magnet is prepared by bonding the rare-earth permanent magnetic powder and a binder.

According to another aspect of the application, there is provided a device, wherein the device using the bonded magnet described above.

In order to disclose the application fully, the contents of the application are now described respectively.

It is mentioned in the application that rare-earth permanent magnetic powder is composed of Sm, Fe, M, Si and N, in which element Si is added for improving the glass-forming ability of the material, the addition amount of element Si is in the range of 0.1~1.5 at %, when the addition amount is less than 0.1 at %, the effect of the invention cannot be achieved, but when the amount of element Si is more than 1.5 at %, the residual magnetism and the magnetic energy product of the material are degraded. Therefore, the content of Si is more preferably 0.2~0.8 at %.

The addition of element M is mainly to reduce the viscosity of the samarium-iron alloy. M is mainly at least one of Be, Cr, Al, Ti, Ga, Nb, Zr, Ta, Mo, and V simultaneously it is necessary to ensure that the addition of these elements does not sharply reduce the magnetic performances of samarium-iron-nitrogen magnetic powder, and M ranges from 0.1 at % to 1.5 at %. When the content of M is less than 0.1 at %, it cannot improve the viscosity of alloy liquid. When the content of M is more than 1.5 at %, the performances of the magnetic powder such as coercivity, residual magnetism and the like will be degraded. M is preferably in the range of 0.5~1.5 at %.

In the previous researches, the effect of Si in the alloy is mainly to increase the glass-forming ability of the alloy. However, good glass-forming ability does not mean that the alloy has good wettability. But when a certain amount of Si is added in conjunction with certain transition metal, the wettability of the alloy can be improved on the basis of certain glass-forming ability. Particularly when M is at least one of Cr, Zr, Mo and V, the wetting effect of the rare-earth permanent magnetic powder prepared is better than the rare-earth permanent magnetic powder prepared by adding other transition metal. Better wettability can reduce the problems of molten alloy splashing during rapid quenching processing and the problems of nozzle clogging during spraying, thereby, increasing the production efficiency, and the yield of alloy. When M is at least one of Cr, Zr, Mo and V, the rare-earth permanent magnetic powder with higher phase structure ratio can also be obtained.

In rare-earth elements, element Sm is the best element of the formation of this kind of compounds. The rare-earth permanent magnetic powder with $TbCu_7$ structure has the highest intrinsic magnetic performances, the addition of other rare-earth elements will reduce the magnetic performances thereof in varying extent, in particular the coercivity. The content of element Sm is in the range of 7~12 at %. When the content of Sm is less than 7 at 90, there are more α-Fe phases of soft magnetic phase easily formed, but when the content of Sm is more than 12 at %, there are also more samarium-rich phases formed, which are unfavorable for increasing the magnetic performances. The application specifies that Sm is in the range of 7~12 at %, preferably 7~10 at %.

In this application, there is also provided a rare-earth permanent magnetic powder, which is composed of rare-earth elements Sm, Fe, M, Si and N, wherein M is composed of Zr and R, and R is at least one of Be, Cr, Al, Ti, Ga, Nb, Ta, Mo, and V. The addition of element Zr has good effects on stabilizing the phase structure of rare-earth permanent magnetic powder, improving the wettability. Particularly when Si is added in conjunction with Zr and R (R is at least one of Be, Cr, Al, Ti, Ga, Nb, Ta, Mo, and V), the addition has a better effect on increasing the phase structure ratio of the rare-earth permanent magnetic powder.

In the application, the content of Sm in the rare-earth permanent magnetic powder is in the range of 7~12 at %, the content of Si is in the range of 0.1~1.5 at %, the content of Zr is in the range of 0.1~3 at %, the content of N is in the range of 5~208 at %, the content of R is in the range of 0.1~1.5 at %, and Fe as the balance. The content of elements Sm, Si and the like in the rare-earth permanent magnetic powder and the effects of these elements have been mentioned above. The point is that, the content of Zr will be briefly described. The content of Zr in the rare-earth permanent magnetic powder is in the range of 0.1~3 at %. When the content of Zr is less than 0.1 at %, the content is so small that the improving effect is not obvious. Additionally, since Zr is a nonmagnetic element, when the content of Zr is too much, whether it occupies rare-earth crystal site of Sm or occupies transition element crystal site of Fe in the compound, the magnetic performances will be reduced. When the content of Zr is in the range of 0.1~3 at %, it makes good effects on stabilizing the phase structure, improving the wettability and maintaining the magnetic performances of the rare-earth permanent magnetic powder.

Preferably, in the rare-earth permanent magnetic powder, the atomic ratio of R to Zr is in the range of 0.05~0.5. When the atomic ratio of R to Zr is set in the range, the rare-earth permanent magnetic powder has more stable phase structure and better wetting effect. Thus the production efficiency of the rare-earth permanent magnetic powder and the yield of alloy can be increased. More preferably, when the atomic ratio of R to Zr is in the range of 0.05~0.2, the rare-earth permanent magnetic powder has higher phase structure ratio and better wettability.

In the rare-earth permanent magnetic powder provided by the application, part of the element Sm may be replaced by other rare-earth elements, and other rare-earth elements account for 0~10 at % of the rare-earth permanent magnetic powder. For example, the addition of Gd, on one hand, can reduce the cost, and on the other hand, can reduce the temperature coefficient and improve the stability. The addition of other heavy rare-earth elements such as Ho, Dy can improve the coercivity and temperature stability, and the addition of a certain amount of light rare-earth elements such as Ce, La is favorable for reducing the cost, increasing the fluidity of alloy liquid and reducing the viscosity. Substitution of Nd and Pr may slightly increase the saturation magnetization of samarium-iron-nitrogen. Substitution amount of more than 10 at % will affects the residual magnetism and magnetic energy product, therefore in the application, 10 at % is selected as the upper limit of other rare-earth elements to be added.

In the rare-earth permanent magnetic powder provided by the application, part of element Fe may be replaced by element Co, and the element Co accounts for 0~30 at % of the rare-earth permanent magnetic powder. The addition of element Co, on one hand, can reduces the viscosity of alloy liquid, also optimizes other performances of rare-earth permanent magnetic powder, such as improving the stability of $TbCu_7$ phase formed, improving the thermal stability of permanent magnetic powder and so on. The addition amount of Co added should be less than or equal to 30 at %, adding too much Co will increases the cost of material, and at the same time it is unfavorable for the residual magnetism of material.

In the application, the main phase of the material is $TbCu_7$ structure. The intrinsic magnetic properties of SmFe alloy with this structure are higher than NdFeB magnetic powder and SmFe magnetic powder of $Th_2Zn_{17}$ structure, and the temperature resistance and corrosion resistance of SmFe alloy with this structure are better than other series of magnetic powder. The samarium-iron of $TbCu_7$ structure is metastable phase, so the formation thereof requires strict component control and process condition control, and it needs to be formed in a quenching (rapid cooling) way. During preparation, compounds with other structures such as $ThMn_{12}$ or $Th_2Ni_{17}$ or $Th_2Zn_{17}$ may generate. In rapid quenching state, the samarium-iron alloy of $TbCu_7$ structure is hard magnetic, while the samarium-iron alloy of $ThMn_{12}$ or $Th_2Ni_{17}$ or $Th_2Zn_{17}$ structure is soft magnetic, so the generation of samarium-iron of other phase structures may degrade the magnetic performances of magnetic powder. However, it can be seen from samarium-iron alloy phase diagram that, the different of the range of samarium-iron alloy components of several phase structures is small, the samarium-iron alloy of $Th_2Ni_{17}$ or $Th_2Zn_{17}$ structure is in a stable state, and the samarium-iron alloy of $TbCu_7$ and $ThMn_{12}$ is in a metastable state. Therefore, the samarium-iron alloy of $Th_2Ni_{17}$ or $Th_2Zn_{17}$ structure is generated inevitably during rapid quenching process. Where specified by the application, the main phase is a $TbCu_7$ phase, and the content is above 80 vol %. When the content of the phase is less than 80 vol %, more soft magnetic phases contained in magnetic powder may result in the coercivity of magnetic powder being too low, so the effect of preparing samarium-iron-nitrogen magnetic powder with high performance cannot be achieved. In the magnetic powder finally prepared in the invention, the content of $TbCu_7$ phase is preferably above 90 vol %, more preferably above 95 vol %.

At the same time, during the preparation process of melt-spinning alloys, in order to facilitate the formation of $TbCu_7$ phase, it is necessary to reduce the content of Sm in the samarium-iron alloy, but this simultaneously facilitates the formation of α-Fesoft magnetic phase and degrades the performance. At the same time, during the heat Treatment processing of melt-spinning samarium-iron alloys and subsequent nitriding process, the metastable $TbCu_7$ phase may also be converted into steady $Th_2Zn_{17}$ structure, to further form α-Fe soft magnetic phase. In the application, through optimizing the process and component, the α-Fesoft magnetic phase in the magnetic powder is reduced, and it specifies that the content of the phase is below 1 vol %.

The application also stipulates average thickness and grain size. The coercivity of flaky magnetic powder is highly related to the grain size of melt-spinning alloys. For the samarium-iron alloy, the magnetic powder obtains good coercivity only if the grain size is between 10 nm~1 μm. In the application, the addition of element Si and other transition elements enhances the fluidity and amorphous forming ability of the alloy, thereby obtaining melt-spinning alloys powder with smaller grains. Through the optimization of the experiment, the grain size is stabilized between 10 nm and 120 nm, more preferably between 20 nm and 80 nm. When the grain size is larger than this range, it will cause sharp decline in coercivity, residual magnetism or the like, which does not reflect the advantage of the invention.

The melt-spinning alloys powder prepared by the application has a thickness of 10~100 μm, preferably 20~60 μm. The thickness of the flake prepared is related to the preparation method, but also is affected by the component. Since the samarium-iron of $TbCu_7$ structure is hard to form, it must be prepared at an extremely rapidly cooling speed, but too fast cooling speed is unfavourable to forming a flake. In the application, the addition of element Si increases the glass-forming ability, so that the flake can be formed at a low speed. The efficiency of the process is increased, the thickness of the formed flake is stabilized, and the microstructure and the grain size are uniformized, which is conducive to increase the magnetic performance of the magnetic powder.

In the application, the samarium-iron-nitrogen powder with the main phase of $TbCu_7$ structure is obtained, the samarium-iron-nitrogen powder is mixed with resin to prepare an isotropic bonded magnet. The bonded magnet may be prepared by a preparation method such as molding, injection, rolling, extruding or the like. The bonded magnet prepared may, be blocky, annular, and so on.

The bonded magnet obtained in the application can applied to the preparation of corresponding device. Through this method, the samarium-iron-nitrogen magnetic powder and magnet with high performance can be prepared, which is favourable to further miniaturization of the device. High temperature resistance and corrosion resistance of the magnetic powder is favourable to using the device in a special environment, and the application of rare-earth samarium is also favourable to balance use of rare-earth resources.

DETAILED DESCRIPTION OF THE INVENTION

The main preparation process is as follows:

(1) firstly proportioning certain samarium-iron alloy, smelting the samarium-iron alloys by Medium-Frequency processing, arc melting to obtain alloy ingots, initially crushing the ingots to obtain the alloy block of several millimeters;

(2) passing alloy liquid obtained by induction melting of the alloy block through a nozzle onto a rotary water-cooled copper wheel, obtaining the samarium-iron alloy powder after emergency cooling the liquid;

(3) crushing the prepared flaky samarium-iron alloy powder and screening to remove ultrafine powder, obtaining powder with particle size of 10~100 μm;

(4) annealing the obtained samarium-iron alloy powder at 750° C. for 5~30 min, homogenizing grain structure, then nitriding at about 450° C. for 30 min under industrial pure nitrogen, gas mixture of hydrogen and ammonia or the like as the nitrogen source;

(5) obtaining the magnetic powder as shown in Table 1 to Table 13 in the embodiments through the above preparation, performing performance test such as thickness, grain size, magnetic performance or the like on the magnetic powder.

The application will be described below through describing the component of rare-earth permanent magnetic powder, plate thickness of alloy powder, grain size, performance of magnetic powder, and performance of magnet.

(1) Component of Rare-Earth Permanent Magnetic Powder

The component of rare-earth alloy powder was formed by nitriding smelted samarium-iron-boron alloy powder, and the component was nitrided magnetic powder.

(2) Flake Thickness of Alloy Powder

The alloy powder was formed by passing the molten alloy liquid through a water cooling roller. The flake thickness was measured by a vernier caliper. In order to make the measurement accurate, 50 pieces of alloy powder in the same batch was measured, then averaged. The flake thickness was denoted as A, in a unit of μm in the embodiment.

(3) Grain Size

The alloy powder obtained was measured through XRD, and the phase structure of magnetic powder obtained was examined by taking Cu target as the target material. The grain size was calculated by Scherrer's formula, i.e.:

$$D=K\lambda/\beta\cos\theta$$

Where K is a Scherrer constant, the value of which is 0.89, generally taking 1;

D is the grain size (nm);

β is integral half width, which needs to be transformed into radian (rad) during calculation;

θ is a diffraction angle;

λ is X-ray wavelength, and the wavelength of Cu target is 0.154056 nm.

Since the grain sizes of the material are not just the same, the calculated value is an average value of different grain sizes. The grain size is denoted as σ, in a unit of nm in the embodiment.

(4) Performance of Magnetic Powder

The performance of magnetic powder was detected by vibrating sample magnetometer (VSM detection).

(5) Phase Ratio

The phase ratio is used as evaluation.

The characteristic peaks of $TbCu_7$ was 42.6°, 36.54°, 48.03°.

The characteristic peaks of $Th_2Zn_{17}$ was 43.7° and 37.5°.

The characteristic peaks of α-Fe was 44.6°.

The content of each phase was determined by the ratio of three characteristic peaks, i.e., the phase ratio Φ was equal to:

$$\phi=\frac{I_{42.6^\circ}+I_{36.5^\circ}+I_{48.03^\circ}}{I_{42.6^\circ}+I_{36.5^\circ}+I_{48.03^\circ}+I_{43.7^\circ}+I_{37.5^\circ}+I_{44.6^\circ}}\times 100\%$$

(6) Yield

Yield is one of factors which must be considered for industrialization. The yield was denoted as θ by ratio of final product quality M1 to input raw material quality M2 in the embodiment:

$$\eta=\frac{M1}{M2}\times 100\%$$

TABLE 1

Embodiment SmFeBeSiN magnetic powder

| No. | Components | λ | σ | Φ | η | Magnetic powder Br | Hcj | (BH)m |
|---|---|---|---|---|---|---|---|---|
| S1 | Sm6.8FebalBe0.7Si0.1N10.5 | 40 | 20 | 87 | 91 | 8.8 | 8.6 | 19.6 |
| S2 | Sm8.8FebalBe0.5Si0.3N12.2 | 40 | 12 | 83 | 92 | 9.4 | 9.0 | 20.6 |
| S3 | Sm7.5FebalBe0.8Si0.8N11.6 | 35 | 32 | 89 | 90 | 10.5 | 7.8 | 20.4 |
| S4 | Sm8.0FebalBe1.2Si0.5N12.2 | 25 | 12 | 93 | 91 | 10.3 | 6.9 | 20.7 |
| S5 | Sm8.3FebalBe1.5Si0.5N12.5 | 40 | 43 | 94 | 89 | 10.6 | 6.7 | 21.3 |
| S6 | Sm9.5FebalBe0.7Si0.5N12.2 | 35 | 25 | 91 | 87 | 9.2 | 8.8 | 20.5 |
| S7 | Sm8.3FebalBe0.7Si0.5N12.7 | 25 | 36 | 92 | 91 | 10.6 | 7.8 | 22.0 |
| S8 | Sm8.7FebalBe0.7Si1.0N12.2 | 40 | 56 | 89 | 92 | 10.2 | 7.6 | 21.3 |
| S9 | Sm10.5FebalBe1.3Si0.3N12.7 | 35 | 63 | 88 | 90 | 8.6 | 10.4 | 19.9 |
| S10 | Sm12.0FebalBe0.8Si0.5N12.2 | 25 | 51 | 88 | 91 | 7.4 | 10.5 | 18.5 |

TABLE 2

Embodiment SmFeCrSiN magnetic powder

| No. | Components | λ | σ | Φ | η | Magnetic powder Br | Hcj | (BH)m |
|---|---|---|---|---|---|---|---|---|
| S1 | Sm8.2FebalCr0.8Si0.8N11.6 | 45 | 15 | 97 | 96 | 10.2 | 8.4 | 22.0 |
| S2 | Sm7.5FebalCr0.8Si0.8N11.6 | 50 | 21 | 97 | 98 | 10.3 | 7.4 | 20.7 |
| S3 | Sm8.0FebalCr0.2Si0.5N12.2 | 35 | 35 | 96 | 96 | 10.5 | 6.9 | 20.6 |
| S4 | Sm8.3FebalCr1.5Si0.5N12.5 | 40 | 12 | 95 | 96 | 10.6 | 6.9 | 20.9 |
| S5 | Sm9.5FebalCr0.7Si0.5N12.2 | 25 | 65 | 95 | 97 | 8.9 | 9.0 | 19.9 |
| S6 | Sm8.3FebalCr0.5Si0.5N10.9 | 20 | 67 | 97 | 96 | 9.9 | 8.2 | 22.1 |
| S7 | Sm8.5FebalCr0.5Si0.3N12.2 | 25 | 80 | 97 | 97 | 10.6 | 6.7 | 20.0 |
| S8 | Sm8.5FebalCr1.3Si0.3N12.2 | 25 | 75 | 97 | 97 | 10.8 | 6.7 | 20.0 |

TABLE 2-continued

| Embodiment SmFeCrSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S9 | Sm8.3FebalCr0.7Si0.2N12.2 | 55 | 42 | 96 | 96 | 10.4 | 7.1 | 20.7 |
| S10 | Sm8.2FebalCr0.9Si1.0N15.0 | 60 | 51 | 97 | 98 | 10.3 | 7.4 | 20.9 |

TABLE 3

| Embodiment SmFeAlSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.2FebalAl0.8Si0.8N11.6 | 20 | 52 | 94 | 91 | 10.1 | 7.4 | 19.0 |
| S2 | Sm7.5FebalAl0.8Si0.8N11.6 | 60 | 25 | 92 | 92 | 8.0 | 9.0 | 18.7 |
| S3 | Sm8.0FebalAl1.2Si0.5N12.2 | 35 | 30 | 83 | 91 | 9.5 | 7.8 | 18.2 |
| S4 | Sm8.3FebalAl1.5Si0.5N12.5 | 25 | 50 | 80 | 89 | 10.6 | 6.7 | 19.2 |
| S5 | Sm9.5FebalAl0.6Si0.5N12.2 | 95 | 10 | 92 | 90 | 8.2 | 8.9 | 18.3 |
| S6 | Sm8.5FebalAl0.5Si0.5N10.9 | 55 | 70 | 91 | 91 | 9.0 | 8.6 | 19.1 |
| S7 | Sm8.3FebalAl0.6Si0.3N12.5 | 45 | 80 | 93 | 92 | 9.8 | 7.2 | 18.3 |
| S8 | Sm8.3FebalAl1.3Si0.3N14.3 | 30 | 35 | 94 | 91 | 10.2 | 7.6 | 19.1 |
| S9 | Sm8.5FebalAl0.7Si0.2N12.2 | 20 | 40 | 89 | 90 | 10.5 | 6.9 | 18.7 |
| S10 | Sm8.2FebalAl0.6Si1.0N12.7 | 35 | 10 | 86 | 87 | 10.4 | 6.4 | 18.5 |

TABLE 4

| Embodiment SmFeTiSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.2FebalTi0.1Si0.3N11.6 | 25 | 44 | 94 | 91 | 10.2 | 7.6 | 19.0 |
| S2 | Sm7.5FebalTi0.8Si0.3N11.6 | 80 | 10 | 93 | 91 | 8.6 | 8.9 | 18.3 |
| S3 | Sm8.0FebalTi1.2Si0.5N12.2 | 20 | 20 | 90 | 92 | 9.8 | 7.6 | 18.7 |
| S4 | Sm8.3FebalTi0.9Si0.8N12.5 | 45 | 13 | 88 | 91 | 9.7 | 7.8 | 18.6 |
| S5 | Sm9.5FebalTi0.9Si0.8N11.2 | 60 | 35 | 93 | 90 | 8.2 | 8.7 | 18.3 |
| S6 | Sm8.5FebalTi0.9Si0.6N10.9 | 35 | 23 | 91 | 89 | 9.5 | 8.0 | 18.9 |
| S7 | Sm8.3FebalTi0.6Si0.3N12.5 | 55 | 63 | 86 | 90 | 10.4 | 7.2 | 19.0 |
| S8 | Sm11.5FebalTi1.3Si0.6N14.3 | 20 | 16 | 94 | 87 | 7.4 | 9.6 | 17.5 |
| S9 | Sm8.5FebalTi0.7Si0.2N12.2 | 40 | 45 | 83 | 91 | 10.7 | 7.5 | 19.2 |
| S10 | Sm8.2FebalTi0.6Si1.0N12.7 | 30 | 34 | 87 | 92 | 10.0 | 7.6 | 19.0 |

TABLE 5

| Embodiment SmFeGaSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm9.5FebalGa0.9Si0.8N11.2 | 90 | 40 | 91 | 92 | 8.8 | 8.6 | 17.8 |
| S2 | Sm8.5FebalGa0.5Si0.6N10.9 | 15 | 12 | 94 | 91 | 10.4 | 7.5 | 18.7 |
| S3 | Sm8.3FebalGa0.6Si0.3N12.5 | 35 | 32 | 88 | 90 | 10.5 | 7.8 | 18.5 |
| S4 | Sm11.3FebalGal.3Si0.6N14.3 | 25 | 12 | 92 | 89 | 8.0 | 8.9 | 17.7 |
| S5 | Sm8.5FebalGa0.7Si0.2N12.2 | 40 | 43 | 94 | 90 | 10.6 | 6.7 | 19.3 |
| S6 | Sm8.1FebalGa0.5Si0.3N11.6 | 35 | 115 | 93 | 92 | 9.2 | 8.8 | 18.6 |
| S7 | Sm7.5FebalGa0.5Si0.3N11.6 | 25 | 36 | 80 | 85 | 8.6 | 8.8 | 17.7 |
| S8 | Sm6.8FebalGa1.2Si0.5N11.2 | 40 | 56 | 93 | 87 | 7.2 | 9.6 | 18.2 |
| S9 | Sm8.3FebalGa0.9Si0.8N12.5 | 35 | 63 | 91 | 91 | 8.6 | 8.4 | 18.1 |
| S10 | Sm9.5FebalGa0.9Si0.8N11.8 | 25 | 21 | 89 | 92 | 7.4 | 8.5 | 17.9 |

TABLE 6

| Embodiment SmFeNbSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm9.5FebalNb0.9Si0.8N12.2 | 45 | 16 | 93 | 92 | 9.2 | 8.4 | 18.9 |
| S2 | Sm8.3FebalNb0.8Si0.5N10.9 | 100 | 21 | 91 | 91 | 10.3 | 7.4 | 19.0 |
| S3 | Sm8.3FebalNb0.9Si0.3N12.5 | 35 | 35 | 92 | 92 | 10.5 | 6.9 | 18.7 |
| S4 | Sm10.5FebalNb1.3Si0.5N12.3 | 55 | 12 | 89 | 89 | 7.6 | 8.9 | 17.8 |
| S5 | Sm8.5FebalNb0.8Si0.2N12.2 | 25 | 65 | 94 | 91 | 9.9 | 8.0 | 19.2 |
| S6 | Sm8.3FebalNb0.6Si0.5N11.6 | 20 | 77 | 94 | 90 | 10.7 | 7.6 | 20.1 |
| S7 | Sm8.0FebalNb0.8Si0.3N12.6 | 35 | 80 | 93 | 92 | 10.6 | 6.7 | 18.2 |
| S8 | Sm7.3FebalNb1.2Si0.5N11.2 | 40 | 75 | 93 | 89 | 9.8 | 6.7 | 18.2 |
| S9 | Sm8.3FebalNb1.1Si0.8N14.5 | 55 | 42 | 94 | 92 | 10.4 | 7.1 | 18.9 |
| S10 | Sm9.1FebalNb0.8Si0.5N11.8 | 60 | 51 | 88 | 91 | 8.3 | 8.4 | 17.8 |

TABLE 7

| Embodiment SmFeZrSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.2FebalZr0.8Si0.8N11.6 | 40 | 17 | 97 | 97 | 7.8 | 8.6 | 18.9 |
| S2 | Sm8.5FebalZr0.8Si0.8N11.6 | 60 | 21 | 97 | 98 | 9.3 | 8.4 | 19.2 |
| S3 | Sm8.0FebalZr1.5Si0.8N12.2 | 30 | 35 | 96 | 98 | 9.5 | 6.9 | 17.6 |
| S4 | Sm8.3FebalZr1.5Si1.3N12.5 | 15 | 12 | 97 | 98 | 9.6 | 7.6 | 18.4 |
| S5 | Sm9.0FebalZr0.5Si0.8N12.2 | 25 | 65 | 96 | 96 | 8.9 | 8.0 | 17.9 |
| S6 | Sm8.3FebalZr0.5Si0.5N11.9 | 20 | 45 | 97 | 97 | 9.7 | 8.4 | 20.1 |
| S7 | Sm8.5FebalZr0.5Si0.3N12.2 | 35 | 30 | 96 | 97 | 8.6 | 8.7 | 18.9 |
| S8 | Sm8.5FebalZr1.5Si0.3N12.2 | 30 | 72 | 97 | 98 | 10.8 | 6.9 | 19.3 |
| S9 | Sm8.3FebalZr0.3Si0.2N12.2 | 55 | 42 | 95 | 98 | 10.4 | 7.3 | 18.9 |
| S10 | Sm8.2FebalZr0.3Si1.0N13.0 | 80 | 11 | 97 | 96 | 9.3 | 8.4 | 19.0 |

TABLE 8

| Embodiment SmFeTaSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.0FebalTa0.7Si0.1N10.5 | 46 | 17 | 90 | 90 | 9.1 | 8.5 | 18.7 |
| S2 | Sm8.0FebalTa0.5Si0.3N13.0 | 11 | 19 | 93 | 92 | 10.4 | 7.3 | 19.0 |
| S3 | Sm8.3FebalTa0.8Si0.8N13.0 | 34 | 37 | 94 | 91 | 10.4 | 7.0 | 18.9 |
| S4 | Sm8.3FebalTa1.2Si0.8N12.2 | 56 | 10 | 85 | 92 | 7.7 | 8.8 | 17.8 |
| S5 | Sm12.3FebalTa0.5Si0.3N12.5 | 24 | 67 | 94 | 90 | 9.8 | 8.1 | 18.9 |
| S6 | Sm8.7FebalTa0.5Si0.3N12.2 | 21 | 75 | 93 | 86 | 10.8 | 7.5 | 20.1 |
| S7 | Sm8.7FebalTa0.5Si0.3N12.7 | 34 | 82 | 86 | 87 | 10.5 | 6.8 | 17.8 |
| S8 | Sm8.7FebalTa0.5Si1.0N12.5 | 41 | 73 | 94 | 91 | 9.9 | 6.6 | 18.2 |
| S9 | Sm9.0FebalTa0.2Si0.2N12.5 | 54 | 44 | 92 | 89 | 10.3 | 7.2 | 19.2 |
| S10 | Sm9.1FebalTa0.8Si0.2N12.5 | 76 | 49 | 94 | 92 | 8.4 | 8.3 | 18.2 |

TABLE 9

| Embodiment SmFeMoSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.0FebalMo0.5Si1.6N12.5 | 27 | 42 | 96 | 96 | 10.4 | 7.7 | 18.9 |
| S2 | Sm8.0FebalMo0.8Si0.8N12.5 | 78 | 12 | 97 | 96 | 8.5 | 8.8 | 18.3 |
| S3 | Sm8.0FebalMo0.8Si0.5N12.5 | 22 | 18 | 97 | 97 | 9.9 | 7.7 | 19.0 |
| S4 | Sm8.3FebalMo0.8Si0.5N12.7 | 43 | 15 | 95 | 97 | 9.6 | 7.7 | 18.6 |
| S5 | Sm8.3FebalMo0.6Si0.2N12.7 | 62 | 33 | 97 | 97 | 8.3 | 8.8 | 17.5 |
| S6 | Sm8.3FebalMo0.6Si0.2N12.7 | 33 | 25 | 97 | 98 | 9.4 | 7.9 | 19.0 |
| S7 | Sm8.3FebalMo0.6Si0.2N12.3 | 57 | 61 | 97 | 96 | 10.5 | 7.3 | 18.7 |
| S8 | Sm8.7FebalMo1.3Si0.2N12.3 | 18 | 18 | 96 | 96 | 7.3 | 8.5 | 18.3 |

TABLE 9-continued

| Embodiment SmFeMoSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S9 | Sm8.7FebalMo0.5Si0.2N12.3 | 42 | 43 | 95 | 97 | 10.8 | 7.6 | 19.0 |
| S10 | Sm8.7FebalMo0.5Si1.0N12.3 | 28 | 36 | 97 | 98 | 9.9 | 7.5 | 19.2 |

TABLE 10

| Embodiment SmFeVSiN magnetic Powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.2FebalV0.7Si0.3N12.6 | 43 | 23 | 96 | 97 | 8.9 | 8.4 | 18.5 |
| S2 | Sm8.2FebalV0.7Si0.3N12.6 | 37 | 12 | 97 | 96 | 9.3 | 8.2 | 19.3 |
| S3 | Sm8.5FebalV0.9Si0.5N12.2 | 38 | 31 | 96 | 98 | 10.6 | 7.6 | 18.1 |
| S4 | Sm8.5FebalV0.9Si0.5N12.5 | 22 | 15 | 97 | 96 | 10.2 | 7.1 | 20.0 |
| S5 | Sm8.5FebalV0.5Si0.8N12.2 | 43 | 43 | 96 | 98 | 10.7 | 6.5 | 18.7 |
| S6 | Sm8.5FebalV0.5Si0.8N11.9 | 32 | 26 | 97 | 98 | 9.1 | 8.0 | 18.6 |
| S7 | Sm8.3FebalV0.6Si0.3N12.5 | 28 | 33 | 95 | 98 | 10.7 | 7.6 | 18.9 |
| S8 | Sm9.1FebalV0.6Si0.2N14.3 | 37 | 59 | 96 | 96 | 10.1 | 7.8 | 19.3 |
| S9 | Sm8.3FebalV0.6Si0.2N12.2 | 38 | 62 | 97 | 98 | 8.7 | 8.2 | 17.8 |
| S10 | Sm8.3FebalV0.6Si0.2N10.7 | 22 | 57 | 96 | 98 | 7.3 | 7.7 | 17.1 |

TABLE 11

| Embodiment SmFeCoMSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.5FebalCo4.9Be0.5Si0.2N12.6 | 86 | 38 | 94 | 92 | 8.6 | 8.7 | 17.9 |
| S2 | Sm8.3FebalCo7.5Cr0.9Si0.2N12.3 | 29 | 14 | 93 | 91 | 10.6 | 7.4 | 18.5 |
| S3 | Sm8.5FebalCo13.4Al0.6Si0.2N12.6 | 31 | 30 | 93 | 89 | 10.3 | 7.9 | 18.7 |
| 54 | Sm7.9FebalCo9.5Ti0.6Si0.5N11.8 | 29 | 14 | 94 | 90 | 8.2 | 8.8 | 18.1 |
| S5 | Sm8.5FebalCo16.3Ga0.8Si0.5N12.9 | 36 | 41 | 94 | 91 | 10.4 | 6.8 | 18.6 |
| S6 | Sm8.6FebalCo7.5Nb1.1Si0.5N12.6 | 39 | 13 | 94 | 92 | 9.4 | 8.7 | 19.3 |
| S7 | Sm8.8FebalCo30.0Zr0.7Si0.8N12.5 | 21 | 34 | 85 | 87 | 8.4 | 8.9 | 17.7 |
| S8 | Sm8.1FebalCo20.1Ta0.7Si0.8N12.6 | 44 | 58 | 92 | 91 | 7.4 | 8.5 | 17.8 |
| S9 | Sm9.2FebalCo12.5Mo0.9Si0.8N13.0 | 31 | 61 | 93 | 90 | 8.4 | 8.8 | 17.7 |
| S10 | Sm8.9FebalCo11.9V0.5Si0.4N12.5 | 29 | 23 | 94 | 92 | 7.6 | 8.9 | 17.8 |

TABLE 12

| Embodiment SmRFeMSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.5La0.3FebalZr0.5Si0.2N12.3 | 40 | 16 | 94 | 92 | 10.3 | 8.2 | 20.1 |
| S2 | Sm8.5Ce0.3FebalV0.5Si0.2N12.7 | 55 | 27 | 87 | 91 | 9.9 | 7.4 | 18.2 |
| S3 | Sm8.5Ce5.1FebalMo0.5Si0.2N12.7 | 30 | 46 | 91 | 89 | 10.6 | 6.9 | 18.6 |
| S4 | Sm8.5Ce11.0FebalZr0.5Si0.2N12.7 | 45 | 19 | 91 | 90 | 10.5 | 6.9 | 18.9 |
| S5 | Sm8.5Pr0.2FebalZr0.5Si0.2N12.6 | 25 | 63 | 90 | 87 | 8.8 | 7.2 | 19.0 |
| S6 | Sm8.5Nd0.2FebalBe0.5Si0.2N12.0 | 25 | 38 | 94 | 91 | 9.3 | 8.6 | 20.0 |
| S7 | Sm8.5Gd0.3FebalGa0.5Si0.2N12.6 | 28 | 78 | 90 | 92 | 10.5 | 6.8 | 18.9 |
| S8 | Sm8.5Ho0.3FebalGa0.5Si0.2N12.5 | 29 | 72 | 94 | 91 | 10.4 | 7.4 | 18.7 |
| S9 | Sm8.5Dy0.2FebalTi0.5Si0.2N12.5 | 53 | 45 | 90 | 92 | 10.3 | 9.1 | 19.0 |
| S10 | Sm7.5La3.1FebalBe0.5Si0.2N13.2 | 64 | 48 | 85 | 90 | 9.1 | 7.7 | 18.1 |
| S11 | Sm7.0Gd2.5FebalGa0.5Si0.2N11.8 | 43 | 17 | 88 | 91 | 11.3 | 8.2 | 17.8 |
| S12 | Sm7.5Dy0.8FebalTi0.5Si0.2N12.5 | 77 | 35 | 89 | 92 | 9.8 | 9.4 | 18.2 |
| S13 | Sm7.5Y0.9FebalTa0.5Si0.2N12.5 | 45 | 53 | 93 | 92 | 10.7 | 6.9 | 18.6 |

It can be seen from the embodiments listed in Table 1 to Table 12 that, all of the rare-earth permanent magnetic powder provided by the application obtained good magnetic performance, and simultaneously the addition of element Si increased the glass-forming ability of material, the ratio of $TbCu_7$ structure of alloy was above 80%. The element Si worked together with element M, so that the viscosity of the rare-earth permanent magnetic powder was reduced and the wettability thereof was improved. Additionally, when M was at least one of Cr, Zr, Mo and V, the co-addition of Si and M might further increase the ratio of the phase structure in the alloy without reducing the magnetic performance, and simultaneously might further improve the wettability of the rare-earth permanent magnetic powder so as to increase the yield of alloy.

TABLE 13

| Embodiment SmFeRZrSiN magnetic powder | | | | | | | | |
|---|---|---|---|---|---|---|---|---|
| | | | | | | Magnetic powder | | |
| No. | Components | λ | σ | Φ | η | Br | Hcj | (BH)m |
| S1 | Sm8.5FebalV0.3Zr0.8Si0.4N12.3 | 20 | 16 | 97 | 95 | 10.4 | 10.1 | 19.0 |
| S2 | Sm8.5FebalMo0.2Zr0.9Si1.2N20.0 | 35 | 29 | 97 | 93 | 9.9 | 9.1 | 18.1 |
| S3 | Sm8.5FebalTa0.4Zr1.1Si0.2N12.7 | 30 | 26 | 96 | 94 | 9.6 | 8.5 | 18.9 |
| S4 | Sm8.5FebalNb0.1Zr2.0Si0.3N12.7 | 43 | 23 | 99 | 95 | 10.5 | 8.5 | 20.4 |
| S5 | Sm8.5FebalGa0.4Zr1.1Si0.9N12.6 | 20 | 23 | 97 | 93 | 8.8 | 8.8 | 18.3 |
| S6 | Sm8.5FebalTi0.2Zr0.5Si0.2N12.0 | 25 | 38 | 95 | 94 | 9.4 | 10.6 | 19.0 |
| S7 | Sm8.5FebalAl0.2Zr0.7Si0.2N12.6 | 22 | 38 | 97 | 95 | 8.9 | 10.8 | 18.6 |
| S8 | Sm8.5FebalCr0.1Zr0.3Si0.2N17.0 | 29 | 52 | 97 | 93 | 9.9 | 9.2 | 18.3 |
| S9 | Sm8.5FebalBe0.4Zr0.9Si0.2N12.5 | 33 | 35 | 96 | 95 | 9.9 | 8.3 | 18.9 |
| S10 | Sm7.5FebalGa0.3Zr2.5Si1.4N13.2 | 34 | 28 | 99 | 94 | 9.1 | 9.8 | 19.6 |
| S11 | Sm7.0FebalTi0.3Zr0.7Si0.2N11.8 | 13 | 17 | 96 | 95 | 10.5 | 8.4 | 18.4 |
| S12 | Sm7.5FebalV0.8Zr1.9Si0.1N12.5 | 30 | 15 | 97 | 93 | 9.8 | 9.4 | 18.8 |
| S13 | Sm7.5FebalTa0.9Zr0.22Si0.1N12.5 | 25 | 21 | 96 | 94 | 10.7 | 8.9 | 18.3 |
| S14 | Sm7.5FebalTa1.2Zr3.0Si0.2N12.5 | 36 | 41 | 97 | 94 | 9.1 | 6.8 | 18.9 |
| S15 | Sm7.5FebalTa0.8Zr2.0Si0.2N12.5 | 43 | 27 | 97 | 95 | 9.3 | 7.4 | 19.0 |
| S16 | Sm7.5FebalTa0.5Zr3.0Si0.7N12.5 | 39 | 13 | 100 | 94 | 10.5 | 9.1 | 20.0 |
| S17 | Sm7.5FebalTa0.2Zr0.8Si0.2N12.5 | 21 | 34 | 97 | 95 | 10.4 | 7.9 | 19.1 |
| S18 | Sm8.0FebalV0.4Zr2.6Si0.4N10.3 | 44 | 58 | 100 | 93 | 10.3 | 8.2 | 19.4 |
| S19 | Sm8.5FebalGa0.5Zr2.5Si1.2N12.7 | 37 | 43 | 98 | 93 | 9.7 | 9.3 | 19.6 |
| S20 | Sm10.5FebalTa0.25Zr1.3Si0.2N12.7 | 15 | 20 | 100 | 95 | 9.9 | 7.9 | 19.5 |
| S21 | Sm8.5FebalNb0.3Zr0.9Si0.3N11.9 | 31 | 61 | 96 | 94 | 9.6 | 7.2 | 18.8 |
| S22 | Sm8.0FebalTi0.4Zr1.1Si0.9N12.6 | 29 | 23 | 97 | 93 | 10.5 | 8.6 | 18.3 |
| S23 | Sm8.3FebalV0.2Zr0.5Si0.2N12.5 | 17 | 44 | 97 | 95 | 9.5 | 9.1 | 18.9 |
| S24 | Sm8.5FebalAl0.2Zr2.1Si0.1N12.6 | 57 | 38 | 99 | 94 | 9.5 | 8.5 | 19.5 |
| S25 | Sm8.5FebalTi0.45Zr2.7Si1.4N5.0 | 63 | 17 | 99 | 94 | 10.1 | 9.2 | 19.8 |
| S26 | Sm12.0FebalCr0.35Zr2.5Si0.2N12.5 | 52 | 27 | 100 | 93 | 9.7 | 9.2 | 19.7 |
| S27 | Sm7.5FebalTa1.5Zr3.0Si0.3N12.7 | 46 | 37 | 96 | 95 | 9.6 | 7.2 | 18.5 |
| S28 | Sm7.5FebalGa0.5Zr0.05Si0.2N13.2 | 70 | 56 | 86 | 89 | 8.3 | 7.1 | 17.5 |
| S29 | Sm7.3FebalV0.7Zr3.5Si0.2N11.8 | 65 | 49 | 94 | 87 | 7.5 | 6.7 | 15.3 |
| S30 | Sm7.5FebalGa0.8Zr0.5Si1.5N12.5 | 45 | 59 | 92 | 92 | 8.7 | 6.4 | 17.5 |
| S31 | Sm7.5FebalTi0.4Zr0.5Si0.2N12.5 | 55 | 68 | 94 | 91 | 9.1 | 7.3 | 17.1 |
| S32 | Sm7.5FebalTa0.9Zr0.5Si0.2N12.5 | 42 | 71 | 93 | 91 | 8.9 | 6.4 | 17.2 |
| S33 | Sm7.3FebalAl0.1Zr2.7Si0.5N11.8 | 31 | 29 | 94 | 94 | 8.5 | 6.4 | 17.3 |

It can be seen from the embodiments in Table 13 that, when M in the rare-earth permanent magnetic powder provided by the invention was Zr and R (R was at least one of Be, Cr, Al, Ti, Ga, Nb, Ta, Mo, and V). And Si, Zr and R are co-added, it was possible to better increase the ratio of $TbCu_7$ structure in the rare-earth permanent magnetic powder, the highest can be achieved to 100% (XRD map can not show the emergence of other impurity phases). Among them, when the atomic ratio of R to Zr was in the range of 0.05~0.2, the magnetic performance, viscosity, yield and phase structure of the rare-earth permanent magnetic powder were the best.

The above is only the preferred embodiment of the invention and not intended to limit the invention. For those skilled in the art, various alterations and changes may be made to the invention. Any modifications, equivalent replacements, improvements and the like made within the spirit and principle of the invention shall fall within the scope of protection of the invention.

What we claim is:

1. A rare-earth permanent magnetic powder, wherein the rare-earth permanent magnetic powder consists essentially of 7~12 at % 0 of Sm, Fe, M, 0.1~1.5 at % Si and 5~20 at % of N, Fe is as the balance, M consists essentially of 0.1~3 at % of Zr and 0.1~1.5 at % of R, wherein R is selected from the group consisting of Be, Cr, Al, Ti, Ga, Nb, Ta, Mo, and V, part of element Sm in the rare-earth permanent magnetic powder is replaced by other rare-earth elements and the other rare-earth accounts for 0~10 at %, part of element Fe in the rare-earth permanent magnetic powder is replaced by element Co and Co accounts for 0~30 at %, and at least 80 vol % of the rare-earth permanent magnetic powder is $TbCu_7$ phase, and wherein the atomic ratio of R to Zr is in the range of 0.05~0.5.

2. The rare-earth permanent magnetic powder according to claim 1, wherein the atomic ratio of R to Zr is in the range of 0.05~0.2.

3. The rare-earth permanent magnetic powder according to any one of claim 1, wherein the content of $TbCu_7$ phase in the rare-earth permanent magnetic powder is above 90 vol %.

4. The rare-earth permanent magnetic powder according to claim 3, wherein the content of $TbCu_7$ phase in the rare-earth permanent magnetic powder is above 95 vol %.

5. The rare-earth permanent magnetic powder according to claim 1 wherein a content of α-Fe in the rare-earth permanent magnetic powder is below 1 vol %.

6. The rare-earth permanent magnetic powder according to claim 1, wherein the average thickness of the rare-earth permanent magnetic powder is 10~100 μm, and the rare-earth permanent magnetic powder is composed of nanometer crystals with an average size of 10~120 nm and amorphous structure.

7. The rare-earth permanent magnetic powder according to claim 6, wherein the average thickness of the rare-earth permanent magnetic powder is 20~60 μm, and the rare-earth permanent magnetic powder is composed of nanometer crystals with an average size of 20~80 nm and amorphous structure.

8. A bonded magnet, wherein the bonded magnet is prepared by bonding the rare-earth permanent magnetic powder according to claim 1 and a bonding agent.

9. A device, wherein the device uses the bonded magnet according to claim 8.

10. The rare-earth permanent magnetic powder of claim 1 having a (BH)m of between 17.1 and 20.4 MGOe.

* * * * *